United States Patent [19]

Tsuchiya et al.

[11] Patent Number: 4,885,270

[45] Date of Patent: Dec. 5, 1989

[54] NOVEL THERMOSENSITIVE RECORDING SHEET

[75] Inventors: Kikuo Tsuchiya, Nishinomiya; Shingo Araki, Settsu; Masaji Inagaki, Ashiya; Yumi Kudoh, Osaka; Teijiro Kitao, Tondabayashi, all of Japan

[73] Assignee: Dainippon Ink and Chemicals, Inc., Tokyo, Japan

[21] Appl. No.: 177,158

[22] Filed: Apr. 4, 1988

[30] Foreign Application Priority Data

Apr. 6, 1987 [JP] Japan ..... 62-82944

[51] Int. Cl.[4] ..... B41M 5/18

[52] U.S. Cl. ..... 503/209; 427/150; 427/151; 428/913; 428/914; 503/208

[58] Field of Search ..... 427/150–152; 428/913, 914; 503/208, 209

[56] References Cited

FOREIGN PATENT DOCUMENTS

| | | | |
|---|---|---|---|
| 74762 | 6/1979 | Japan | 503/208 |
| 139740 | 10/1979 | Japan | 503/208 |
| 0181894 | 11/1982 | Japan | 503/208 |
| 0199286 | 11/1984 | Japan | 503/209 |
| 0078782 | 5/1985 | Japan | 503/209 |
| 1293889 | 12/1986 | Japan | 503/208 |
| 2142683 | 6/1987 | Japan | 503/208 |

*Primary Examiner*—Bruce H. Hess
*Attorney, Agent, or Firm*—Sherman and Shalloway

[57] ABSTRACT

A novel thermosensitive recording sheet having a coated film containing a color-forming lactone compound, an acidic substance and a sensitizer, said sensitizer being an o-hydroxy aromatic acid ester represented by formula

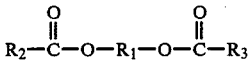

(I)

wherein $R_1$ denotes an alkylene group, a cycloalkylene group, an oxyalkylene group, a thioalkylene group, a phenylene group, a xylylene group or a napthylene group, $R_2$ denotes

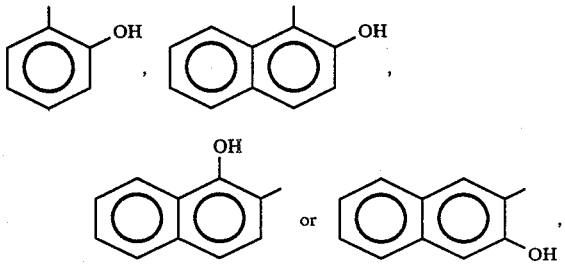

$R_3$ denotes

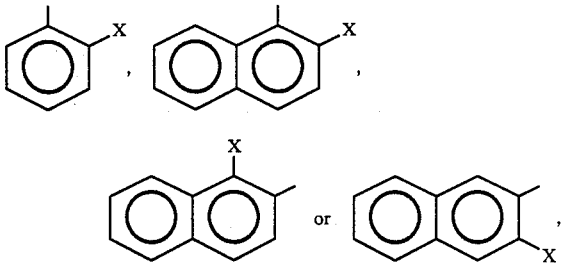

in which X denotes a hydroxy group or a hydrogen atom, provided a benzene ring and a naphthalene ring in $R_1$, $R_2$ and $R_3$ may be substituted by a lower alkyl group, a nitro group or a halogen atom.

12 Claims, No Drawings

NOVEL THERMOSENSITIVE RECORDING SHEET

This invention relates to a thermosensitive recording sheet, and more specifically, to a thermosensitive recording sheet having a coated film containing a color-forming lactone compound, an acidic substance and a specific o-hydroxy aromatic acid ester as a sensitizer.

Thermosensitive recording sheets are designed to display images such as characters and geometric figures by thermal energy, and have recently found applications in various printer recorders, facsimiles, POS labels, automatic ticket examination, etc. There are various methods of thermosensitive recording. From the viewpoint of the clearness, resolution and color of images, the most prevalent method is to use a color-forming lactone compound such as Crystal Violet Lactone (CVL) which is a dye precursor and an acidic substance capable of causing the lactone compound to form a color. In this method, a phenolic compound such as bisphenol A which is solid at room temperature but upon heating, is melted and acts as an acid component has previously been used as the acidic substance. Usually, to obtain a brilliant color, the sheets must be maintained at a temperature of about 140° to 150° C. for a period of time above a certain limit. Hence, various approaches have been made in order to obtain brilliant colors more rapidly and more easily. For example, there are a method in which stearamide is added as a sensitizer (Japanese Laid-Open Patent Publication No. 139740/1979), and a method in which benzyl p-hydroxybenzoate is used as the acidic substance (Japanese Laid-Open Patent Publication No. 74762/1979). The methods described in these patent documents are still not entirely satisfactory to meet the latest demands for higher speed of recording and energy saving although they can increase color-forming sensitivity.

It is an object of this invention to remedy the foregoing drawbacks in the prior art.

The present inventors have made studies to achieve the object and as a result, discovered that use of a specific hydroxy aromatic acid ester as a sensitizer can give a thermosensitive recording sheet having a markedly high color-forming sensitivity than in the case of using conventional sensitizers.

According to this invention, there is provided a thermosensitive recording sheet having a coated film containing a color-forming lactone compound, an acidic substance and a sensitizer, said sensitizer being an o-hydroxy aromatic acid ester represented by formula (I)

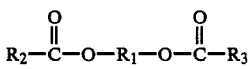

(I)

wherein $R_1$ denotes an alkylene group, a cycloalkylene group, an oxyalkylene group, a thioalkylene group, a phenylene group, a xylylene group or a naphthylene group, $R_2$ denotes

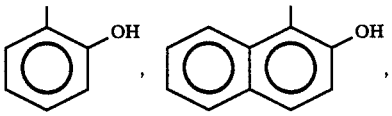

-continued

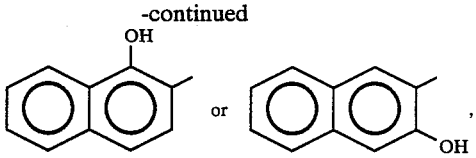

$R_3$ denotes

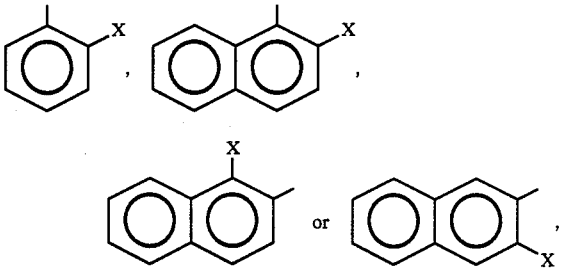

in which X denotes a hydroxy group or a hydrogen atom, provided a benzene ring and a naphthalene ring in $R_1$, $R_2$ and $R_3$ may be substituted by a lower alkyl group, nitro group or a halogen atom.

Examples of an alcohol component as one component constituting the o-hydroxy aromatic acid ester of formula (I) include aliphatic diols such as ethylene glycol, 1,3-propylene glycol, 1,2-propylene glycol, 1,4-butylene glycol, 1,5-pentamethylene glycol, 1,6-hexamethylene glycol, hexyleneglycol(2-methyl-2,4-pentanediol), neopentylglycol(2,2-dimethyl-1,3-propanediol), 1,3-butylene glycol, 1,4-cyclohexanediol and pinacol(tetramethylene glycol); aliphatic oxydiols such as diethylene glycol, dipropylene glycol, triethylene glycol and tripropylene glycol; aliphatic thiodiols such as thiodiethyleneglycol-(2,2'-thiodiethanol) and ethylenebis-(2-hydroxyethylsulfide); and aromatic diols such as resorcinol(m-dihydroxybenzene), catechol(o-dihydroxybenzene), hydroquinone(p-dihydroxybenzene) and p-xylylene glycol. Examples of acid component as the other component constituting the o-hydroxy aromatic ester of formula (I) include o-hydroxy aromatic carboxylic acids such as salicylic acid, o-cresotinic acid, 5-chlorosalicylic acid, 1-hydroxy-2-naphthoic acid, 3-hydroxy-2-naphthoic acid and 1-hydroxy-4-chloro-2-naphthoic acid; and carboxylic acids such as benzoic acid, toluic acid, anisic acid, chlorobenzoic acid, nitrobenzoic acid and naphthoic acid.

Among these o-hydroxy aromatic acid esters, those having a boiling point of 50° to 140° C. are preferable because they are excellent in stability at room temperature and color-forming sensitivity in heating. Specific examples include the following o-hydroxy aromatic acid esters (1) to (23).

(1) Ethyleneglycol di(salicylate)
(2) 1,3-Propyleneglycol di(salicylate)
(3) 1,2-propyleneglycol di(salicylate)
(4) 1,4-Butyleneglycol salicylate-p-toluylate
(5) 1,4-Butyleneglycol di(salicylate)
(6) Ethyleneglycol salicylate benzoate
(7) Ethyleneglycol salicylate-1-hydroxy-2-naphthoate
(8) 1,5-Pentamethyleneglycol di(salicylate)
(9) 1,5-Pentamethyleneglycol salicylate-1-hydroxy-2-naphthoate
(10) 1,6-Hexamethyleneglycol di(salicylate)
(11) Ethyleneglycol di(5-chlorosalicylate)

(12) Diethyleneglycol di(salicylate)
(13) Diethyleneglycol salicylate-1-hydroxy-2-naphthoate
(14) Diethyleneglycol di(1-hydroxy 2-naphthoate)
(15) Triethyleneglycol di(1-hydroxy-2-naphthoate)
(16) Thiodiethyleneglycol di(salicylate)
(17) Neopentylglycol di(1-hydroxy-2-naphthoate)
(18) Resorcinol di(salicylate)
(19) Resorcinol salicylate-p-toluylate
(20) p-Xylyleneglycol di(salicylate)
(21) Ethyleneglycol di(o-cresotiate)
(22) Ethyleneglycol di(m-cresotiate)
(23) 1,4-Cyclohexanediol di(salicylate)

Of these, the o-hydroxy aromatic acid esters (1), (2), (3), (6), (10), (16), (21) and (22) are most preferable.

Examples of the color-forming lactone compound used in this invention include fluoranphthalides such as 3,3-bis(p-dimethylaminophenyl)phthalide, 3,3-bis(p-dimethylaminophenyl)-6-dimethylaminophthalide (also known as Crystal Violet Lactone; CVL for short), 3,3-bis(p-dimethylaminophenyl)-6-aminophthalide, 3,3-bis(p-dimethylaminophenyl)-6-nitrophthalide, 3,3-bis(p-dimethylaminophenyl)phthalide, 3,3-bis-3-dimethylamino-7-methylfluoran, 3-diethylamino-7-chlorofluoran, 3-diethylamino-6-chloro-7-methylfluoran, 3-diethylamino-7-anilinofluoran, 3-diethylamino-6-methyl-7-anilinofluoran, 3-piperidino-6-methyl-7-anilinofluoran, 3-(N-ethyl-p-toluidino)-7-(N-methylanilino)-fluoran, 3-(N-ethyl-p-toluidino)-6-methyl-7-anilinofluoran 3-N-ethyl-N-isoamylamino-6-methyl-7-anilinofluoran, 3-N-methyl-N-cyclohexylamino-6-methyl-7-anilinofluoran and 3-N,N-diethylamino-7-o-chloroanilinofluoran; lactams such as Rhodamin B lactam; and spiropyrans such as 3-methylspirodinaphtopyran, 3-ethylspirodinaphthopyran and 3-benzylspironaphthopyran. These compounds should be colorless or pale-colored and react with acidic substances to form colors.

The acidic substance used in this invention may be any acidic substance which is solid at room temperature and when heated to about 60° to 180° C., is melted and opens the lactone ring of the color-forming lactone compound. It functions well in the presence of sensitizers. Examples of the acidic substance include 4-phenylphenol, 4-hydroxyacetophenone, 2,2'-dihydroxydiphenyl, 2,2'-methylenebis(4-chlorophenol), 2,2'-methylenebis(4-methyl-6-t-butylphenol), 4,4'-isopropylidenediphenol (also known as bisphenol A), 4,4'-isopropylidenebis(2-chlorophenol), 4,4'-isopropylidenebis(2-methylphenol), 4,4'-ethylenebis(2-methylphenol), 4,4'-thiobis(6-t-butyl-3-methylphenol), 1,1-bis(4-hydroxyphenyl)-cyclohexane, 2,2'-bis(4-hydroxyphenyl)-n-heptane, 4,4'-cyclohexylidenebis(2-isopropylphenol), 4,4'-sulfonyldiphenol, salicylanilide, novolak-type phenolic resin and benzyl p-hydroxybenzoate.

The acidic substance is used in an amount of usually 10 to 1,000 parts by weight (all parts hereinafter are by weight), preferably 100 to 500 parts, per 100 parts of the color-forming lactone compound.

The sensitizer is used in an amount of usually 1 to 1,000 parts, preferably 30 to 100 parts, per 100 parts of the acidic substance.

The color-forming lactone compound, the acidic substance and the sensitizer are used in the form of fine particles, preferably fine particles having a particle diameter of less than several microns.

Various known methods can be used to produce the thermosensitive recording sheet. Usually, there may be used (1) a method which comprises preparing a coating dispersion of the color-forming lactone compound, the acidic substance and the sensitizer in water, and coating the coating dispersion on a sheet substrate, and (2) a method which comprises dispersing the color-forming lactone compound and the acidic substance separately in water, including the sensitizer into at least one of the aqueous coating dispersions, and coating the coating dispersions in superimposed relation on a sheet substrate. An aqueous binder should be added to the coating dispersions. Examples of the binder are polyvinyl alcohol, methyl cellulose, hydroxyethyl cellulose, carboxymethyl cellulose, starches, and styrene/maleic acid copolymer. Besides, ultraviolet absorbers (for example, benzophenone compounds and triazole compounds) fillers such as calcium carbonate, lubricants such as polyethylene wax and paraffin wax, agents for imparting water resistance, and other various chemicals may be added to the coating dispersions in order to improve their performance. Various dispersing agents for dispersing the various chemicals in the above coating dispersions may also be added.

The coating dispersion is coated on a sheet substrate so that its dry weight becomes generally 2 to 12 g per $m^2$ of the sheet substrate, and then dried at room temperature to about 50° C. to give the thermosensitive recording sheet of the invention.

Paper is generally used as the sheet substrate, but plastic sheets and nonwoven sheets may also be used.

The thermosensitive recording sheet of this invention has very high color-forming sensitivity and its colored and non-colored portions have excellent stability.

The following Examples, Comparative Examples and Test Example illustrate the present invention more specifically. It should be understood that the invention is not limited at all by these examples. All parts and percentages in these examples are by weight.

EXAMPLE 1

| Dispersion A (containing a dye) | |
|---|---|
| 3-(N—isoamyl-N—ethylamino)-6-methyl-7-anilinofluoran | 1.0 part |
| o-Hydroxy aromatic acid ester (1) [ethyleneglycol (disalicylate)] | 2.0 parts |
| 10% Aqueous solution of polyvinyl alcohol | 3.0 parts |
| Water | 5.0 parts |
| Total | 11.0 parts |

| Dispersion B (containing an acidic substance) | |
|---|---|
| bisphenol A | 3.0 parts |
| Calcium carbonate | 3.0 parts |
| Zinc stearate | 0.5 part |
| 10% Aqueous solution of polyvinyl alcohol | 7.0 parts |
| Water | 10.0 parts |
| Total | 23.5 parts |

Dispersions A and B were separately prepared by mixing the indicated ingredients and pulverizing and dispersing them by a paint conditioner.

Subsequently, 11.0 parts of dispersion A and 23.5 parts of dispersion B were mixed to form a thermosensitive coating dispersion. It was coated on high-quality paper at a rate of 64.5 g/$m^2$ so that its amount upon drying became 8 g/$m^2$, and then dried to obtain a thermosensitive recording sheet in accordance with this invention.

This sheet had excellent color-forming sensitivity and excellent stability at the colored and non-colored portions.

EXAMPLES 2–23

Thermosensitive recording sheets in accordance with this invention were prepared in the same way as in Example 1 except that the o-hydroxy aromatic acid esters (2) to (23) were used instead of the o-hydroxy aromatic acid ester (1).

These sheets had excellent color-forming sensitivity and excellent stability at the colored and noncolored portions.

EXAMPLE 24

A thermosensitive recording sheet in accordance with this invention was prepared in the same way as in Example 1 except that the amount of the o-hydroxy aromatic acid ester (1) added was changed to 1.0 part and the amount of dispersion A was changed to 10 parts.

The sheet had excellent color-forming sensitivity and excellent stability at the colored and non-colored portions.

EXAMPLE 25

A thermosensitive recording sheet in accordance with this invention was prepared in the same way as in Example 1 except that the amount of the o-hydroxy aromatic acid ester (1) added was changed to 4.0 parts and the amount of dispersion A used was changed to 13 parts.

The sheet had excellent color-forming sensitivity and excellent stability at the colored and non-colored portions.

COMPARATIVE EXAMPLE 1

A thermosensitive recording sheet for comparison was prepared in the same way as in Example 1 except that the o-hydroxy aromatic acid ester (1) was not added and the amount of dispersion A used was changed to 9.0 parts.

The sheet had inferior color-forming sensitivity.

COMPARATIVE EXAMPLE 2

A thermosensitive recording sheet for comparison was prepared in the same way as in Example 1 except that stearamide was used instead of the o-hydroxy aromatic acid ester (1).

The sheet was inferior in color-forming sensitivity and stability at the colored and non-colored portions.

COMPARATIVE EXAMPLE 3

A thermosensitive recording sheet for comparison was prepared in the same way as in Example 1 except that the o-hydroxy aromatic ester (1) was not added, the amount of dispersion A used was changed to 9 parts and benzyl p-hydroxybenzoate was used instead of bisphenol A.

The sheet was inferior in color-forming sensitivity and stability at the colored portion.

TEST EXAMPLE 1

The thermosensitive recording sheets obtained in Examples 1 to 25 and Comparative Examples 1 to 3 were tested for dynamic image density, and the stability of the colored and non-colored portions by methods described below. The results are shown in Tables 1 and 2.

Measurment of the dynamic image density

An image was printed on the thermosensitive recording sheet by means of a thermal head printing device (Model MSI, made by Matsushita Electronic Components Co., Ltd.) with a pulse width of 0.5 millisecond, and the density of the image was measured by a Macbeth densitometer (RD-918, made by Macbeth Co., U.S.A.).

Evaluation of the stability of the colored and non-colored portions

The sheet was pressed against a hot plate at 140° C. under a pressure of 2.0 kg/cm$^2$ for 1 second. The colored portion and the remaining non-colored portion were left to stand at 40° C. and 90% RH for 24 hours. The degree of whitening or background fog of the colored and non-colored portions was visually observed and evaluated on the following scale.

(1) Scale of evaluation of the colored portion
◎ : No whitening
○: Hardly any whitening
Δ: Whitening occurred
X: Marked whitening (2) Scale of evaluation of the non-colored portion
◎ : No background fog
○ : Hardly any background fog
Δ: Background fog occurred
X: Marked background fog

TABLE 1

| | Dynamic image density | Stability of colored portion | Stability of non-colored portion |
|---|---|---|---|
| Example 1 | 1.20 | ◎ | ◎ |
| Example 2 | 1.23 | ◎ | ◎ |
| Example 3 | 1.15 | ◎ | ◎ |
| Example 4 | 1.05 | ◎ | ◎ |
| Example 5 | 1.05 | ◎ | ◎ |
| Example 6 | 1.12 | ◎ | ◎ |
| Example 7 | 1.02 | ◎ | ◎ |
| Example 8 | 1.06 | ◎ | ○ |
| Example 9 | 1.02 | ◎ | ◎ |
| Example 10 | 1.25 | ◎ | ◎ |
| Example 11 | 1.08 | ◎ | ◎ |
| Example 12 | 1.12 | ◎ | ○ |
| Example 13 | 1.02 | ◎ | ◎ |
| Example 14 | 1.00 | ◎ | ◎ |
| Example 15 | 1.02 | | ◎ |

TABLE 2

| | Dynamic image density | Stability of colored portion | Stability of non-colored portion |
|---|---|---|---|
| Example 16 | 1.17 | ◎ | ◎ |
| Example 17 | 1.05 | ◎ | ◎ |
| Example 18 | 0.98 | ◎ | ○ |
| Example 19 | 1.09 | ◎ | ◎ |
| Example 20 | 1.08 | ◎ | ◎ |
| Example 21 | 1.20 | ◎ | ◎ |
| Example 22 | 1.15 | ◎ | ○ |
| Example 23 | 1.01 | ◎ | ◎ |
| Example 24 | 1.02 | ◎ | ◎ |
| Example 25 | 1.26 | ◎ | ◎ |
| Comparative Example 1 | 0.42 | ○ | ◎ |
| Comparative Example 2 | 0.80 | Δ | Δ |
| Comparative | 0.78 | X | ○ |

TABLE 2-continued

| | Dynamic image density | Stability of colored portion | Stability of non-colored portion |
|---|---|---|---|
| Example 3 | | | |

What we claim is:

1. A thermosensitive recording sheet comprising a substrate sheet and a film coated on said substrate sheet, said film comprising a color-forming lactone compound, an acidic substance and a sensitizer, said sensitizer being an o-hydroxy aromatic acid ester represented by the formula

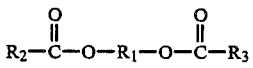

(I)

wherein $R_1$ denotes an alkylene group, a cycloalkylene group, an oxyalkylene group, a thioalkylene group, a phenylene group, a xylylene group or a naphthylene group, $R_2$ denotes

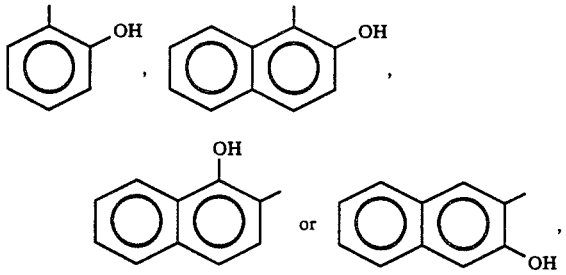

$R_3$ denotes

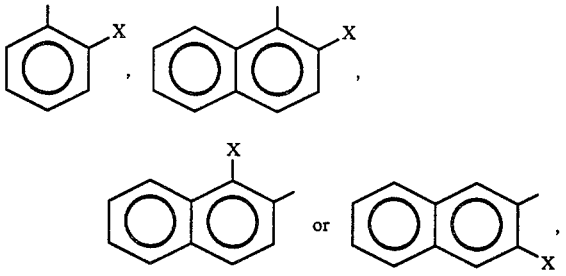

in which X denotes a hydroxy group or a hydrogen atom, provided a benzene ring and a naphthalene ring in $R_1$, $R_2$ and $R_3$ may be substituted by a lower alkyl group, a nitro group or a halogen atom.

2. The thermosensitive recording sheet of claim 1 wherein the sensitizer is at least one of the following o-hydroxy aromatic acid esters (1) to (23), (1) ethyleneglycol di(salicylate),
(2) 1,3-propyleneglycol di(salicylate),
(3) 1,2-propyleneglycol di(salicylate),
(4) 1,4-butyleneglycol salicylate-p-toluylate,
(5) 1,4-butyleneglycol di(salicylate),
(6) ethyleneglycol salicylate benzoate,
(7) ethyleneglycol salicylate-1-hydroxy-2-naphthoate,
(8) 1,5-pentamethyleneglycol di(salicylate),
(9) 1,5-pentamethyleneglycol salicylate-1-hydroxy-2-naphthoate,
(10) 1,6-hexamethyleneglycol di(salicylate),
(11) ethyleneglycol di(5-chlorosalicylate),
(12) diethyleneglycol di(salicylate),
(13) diethyleneglycol salicylate-1-hydroxy-2-naphthoate,
(14) diethyleneglycol di(1-hydroxy-2-naphthoate),
(15) triethyleneglycol di(1-hydroxy-2-naphthoate),
(16) thiodiethyleneglycol di(salicylate),
(17) neopentylglycol di(1-hydroxy-2-naphthoate),
(18) resorcinol di(salicylate),
(19) resorcinol salicylate-p-toluylate,
(20) p-xylyleneglycol di(salicylate),
(21) ethyleneglycol di(o-cresotiate),
(22) ethyleneglycol di(m-cresotiate), and
(23) 1,4-cyclohexanediol di(salicylate).

3. The thermosensitive recording sheet of claim 1 wherein the sensitizer is at least one of ethyleneglycol di(salicylate), 1,3-propyleneglycol di(salicylate), 1,2-propyleneglycol di(salicylate), ethyleneglycol salicylate benzoate, 1,6-hexamethyleneglycol di(salicylate), thiodiethyleneglycol di(salicylate), ethyleneglycol di(o-cresotiate) and ethyleneglycol di(m-cresotiate).

4. The thermosensitive recording sheet of claim 1, 2 or 3 wherein the amount of the acidic substance in the coated film is 100 to 500 parts by weight per 100 parts by weight of the color-forming lactone compound.

5. The thermosensitive recording sheet of claim 4 wherein the amount of the sensitizer in the coated film is 30 to 100 parts by weight per 100 parts by weight of the acidic substance.

6. The thermosensitive recording sheet of claim 1, 2 or 3 wherein the amount of the sensitizer in the coated film is 30 to 100 parts by weight per 100 parts by weight of the acidic substance.

7. The thermosensitive recording sheet of claim 1 wherein said color-forming lactone compound is selected from the group consisting of fluoranphthalides, lactams and spiropyrans.

8. The thermosensitive recording sheet of claim 1 wherein said acidic substance is a solid at room temperature.

9. The thermosensitive recording sheet of claim 1 wherein said acidic substance is melted when heated to about 60° to 180° C.

10. The thermosensitive recording sheet of claim 1 wherein said acidic substance is present in an amount of 10 to 1,000 parts by weight per 100 parts by weight of the colorforming lactone compound.

11. The thermosensitive recording sheet of claim 1 wherein said sensitizer is present in an amount of 1 to 1,000 parts by weight per 100 parts by weight of the acidic substance.

12. The thermosensitive recording sheet of claim 1 wherein said substrate sheet is paper.

* * * * *